US005106398A

United States Patent [19]

Dunn et al.

[11] Patent Number: 5,106,398

[45] Date of Patent: Apr. 21, 1992

[54] AIR SEPARATION

[75] Inventors: Graeme J. Dunn; Robert Owen, Guildford; John D. Oakey, Godalming, all of England; David J. Kamrath, Asbury; Robert A. Mostello, Somerville, both of N.J.

[73] Assignee: The BOC Group plc, Windlesham, England

[21] Appl. No.: 445,074

[22] Filed: Dec. 4, 1989

[51] Int. Cl.[5] ..... F25J 3/00

[52] U.S. Cl. ..... 62/20; 62/24

[58] Field of Search ..... 62/20, 24

[56] References Cited

U.S. PATENT DOCUMENTS

| | | | |
|---|---|---|---|
| 3,010,286 | 11/1961 | Baker et al. | 62/20 |
| 4,588,427 | 5/1986 | Yao et al. | 62/20 |
| 4,636,334 | 1/1987 | Skinner et al. | 62/20 |
| 4,765,814 | 8/1988 | Bauer et al. | 62/20 |
| 4,867,772 | 9/1989 | Eyre | 62/24 |
| 4,957,523 | 9/1990 | Zarate et al. | 62/24 |

FOREIGN PATENT DOCUMENTS 0183446 11/1985 European Pat. Off. .

0299364 7/1988 European Pat. Off. .

*Primary Examiner*—Ronald C. Capossella

*Attorney, Agent, or Firm*—Robert I. Pearlman; David M. Rosenblum; Carol A. Nemetz

[57] ABSTRACT

In order to provide 'ultra high purity' nitrogen having diminished concentrations of light and heavy impurities in comparison with nitrogen produced by conventional cryogenic air separation, the nitrogen product from a conventional cryogenic air separation column is introduced into the bottom of a liquid-vapor contract column 2 fitted with a condenser 8 to provide reflux. A liquid nitrogen stream having a reduced concentration of heavy impurities is withdrawn from the column 2 through an outlet 22 situated at a level a few trays below the top tray in the column 2. The liquid nitrogen is then subjected to two stages of flash separation. In the first stage the liquid is passed through valve 24 into a phase separator 26. In the second stage, the resulting liquid from the first stage, having a reduced concentration of light impurities, is passed through valve 32 into a phase separator 34. Liquid nitrogen product is withdrawn from the phase separator 34 through outlet 38.

15 Claims, 6 Drawing Sheets

AIR SEPARATION

TECHNICAL FIELD

This invention relates to air separation. In particular, it relates to the production of what is sometimes termed "Ultra High Purity" nitrogen or "Ultra Pure" nitrogen

BACKGROUND TO THE INVENTION

Many tens of thousands of tonnes of high purity nitrogen are produced each year worldwide. This nitrogen is produced by the well-known process of fractionally distilling air at cryogenic temperatures. The nitrogen produced typically has a purity of at least 99.9% which makes it suitable for use in a wide range of industrial processes. The main impurity in the high purity nitrogen is argon and typically there might be in the order of 150 volumes per million of argon present. In addition, the nitrogen will also contain a few volumes per million of chemically reactive gases comprising oxygen, hydrogen and carbon monoxide. The nitrogen may also contain some tens of volumes per million of neon and a few volumes per million of helium. The hydrogen, oxygen and carbon monoxide impurities although at an extremely low level are still nonetheless undesirable when it is required to use the nitrogen in the fabrication of micro-electronic products. Accordingly, there is a demand for nitrogen of an even higher purity than that normally provided.

One way of meeting this demand has been to subject the nitrogen to a process of catalytic combustion to remove traces of the reactive gases. However, in some instances, this process is not suitable because the gas becomes contaminated with particles generated from the catalyst granules. Alternative adsorptive purification methods are known but these too involve a risk of contamination by particles from the adsorbent granules.

There is thus a need for new methods of producing nitrogen to a higher standard of purity than has hitherto been achieved by conventional cryogenic methods.

SUMMARY OF THE INVENTION

According to the invention, there is provided a method of purifying nitrogen containing light impurities and heavy impurities comprising introducing a feed stream of the nitrogen into a liquid-vapour contact column, providing in the column a descending flow of liquid nitrogen, absorbing heavy impurities into the descending liquid, and withdrawing from the column a first stream of a first fraction having an enhanced concentration of heavy impurities and a second stream of a second fraction having a reduced concentration of heavy impurities.

The invention also provides apparatus for purifying nitrogen comprising a source of nitrogen containing light and heavy impurities, and a liquid-vapour contact column having an inlet for a nitrogen stream in communication with the source, means associated therewith for creating in the column a descending flow of liquid nitrogen whereby the column is operable to absorb heavy impurities into descending liquid, and a first outlet for a first stream of a first fraction having an enhanced concentration of heavy impurities and a second outlet for a second stream of a second fraction having a reduced concentration of heavy impurities.

The light impurities (hydrogen, helium and neon) may be separated from the nitrogen feed upstream of the liquid-vapour contact column or may if desired be separated from said second stream. The light impurities may be stripped therefrom in a distillation column. However, it is preferred that the feed stream of nitrogen for purification is introduced into the absorbing column under pressure, and a liquid nitrogen stream having a reduced concentration of heavy impurities is withdrawn therefrom as the second stream and is subjected to at least one and preferably two stages of flash separation to produce a purified liquid nitrogen product containing a reduced proportion of both light and heavy impurities in comparison to the nitrogen fed to the said liquid vapour contact column. The second fraction is preferably withdrawn from an intermediate stage of the liquid-vapour contact column whereby although it has a substantially reduced concentration of heavy impurities, its content of light impurities is less than that which obtains in the liquid phase at the top of the column. The liquid-vapour contact column is preferably provided with a condenser to condense nitrogen vapour having a reduced content of heavy impurities (carbon monoxide, argon and oxygen) and to feed the resulting condensate back to the said liquid-vapour contact column as reflux.

In embodiments of the invention in which the liquid-vapour contact column is operated at a relatively high pressure (say in the order of 5–6 atmospheres absolute) liquid oxygen is preferably used to provide refrigeration for the condenser (although liquid air and/or liquid nitrogen may instead be used for this purpose). In such embodiments, in which the liquid-vapour contact column is operated at a relatively high pressure such as 6 bar absolute, advantage can be gained by performing three stages of flash separation, in that a particularly low concentration of light impurities in the final product nitrogen may be achieved.

Preferably, a bleed stream of uncondensed nitrogen is discharged from the passages in the condenser for condensing nitrogen. By discharging such a stream, it is possible to reduce the tendency for light impurities to concentrate at the top of the condenser.

The process and apparatus according to the invention may be used to produce nitrogen containing less than 0.1 volumes per million of gaseous impurities.

BRIEF DESCRIPTION OF THE DRAWINGS

The method and apparatus according to the invention will now be described by way of example with reference to the accompanying drawings in which.

DETAILED DESCRIPTION OF THE INVENTION

Figure 1:
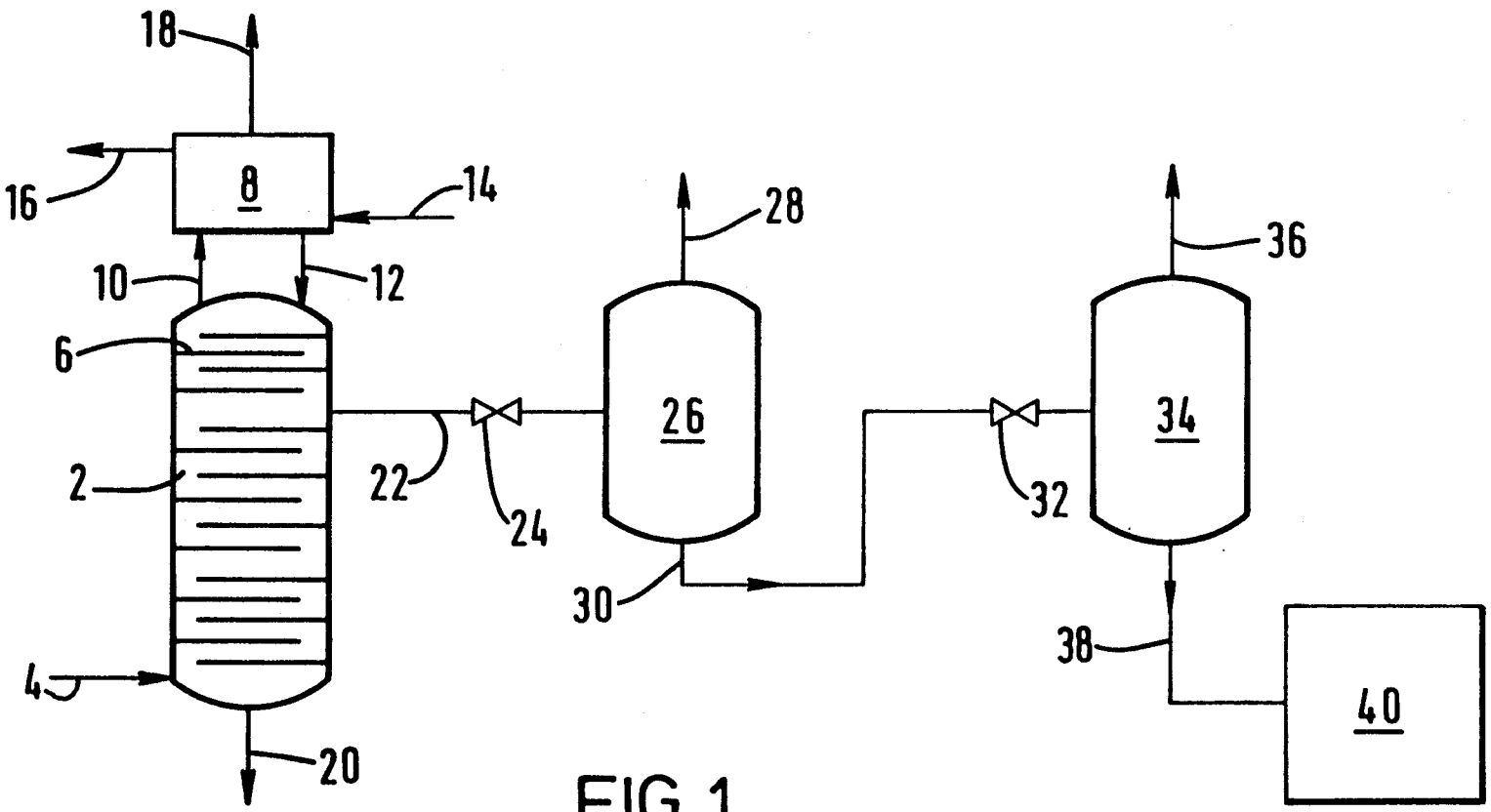
FIG. 1 is a schematic circuit diagram illustrating generally an air separation plant for producing ultra pure nitrogen.

In the ensuing description like parts occurring in different Figures are indicated by the same reference numerals.

Referring to FIG. 1 of the drawings, a pressurized, gaseous nitrogen stream typically containing in the order of 200 volumes per million (VPM) of gaseous impurities continuously enters a liquid-vapour contact column 2 through an inlet 4 at its bottom. The stream is preferably taken from a distillation column (not shown in FIG. 1) in which air is distilled at a pressure substantially greater than atmospheric pressure. For example, the column may be the higher pressure column of a conventional double column plant for separating air. This column typically operates at a pressure in the order of 6 atmospheres. The nitrogen stream may be taken from the aforesaid distillation column either in the gaseous state or the liquid state. If it is taken in the liquid state it should be reboiled upstream of its entry into the column 2. If however air is taken in the gaseous state there is no need for a reboiler to be associated with the liquid-vapour contact column as liquid is withdrawn from the bottom of the column.

The liquid-vapour contact column 2 is provided with means for effecting intimate contact and hence mass exchange between an ascending vapour phase and a descending liquid phase. Means for providing such liquid-vapour contact are well known in the art and may for example comprise a multiplicity of spaced horizontal sieve trays 6.

The liquid-vapour contact column 2 is provided with a condenser 8. Vapour passes from above the liquid-vapour contact means 6 through a column outlet 10 into the condenser 8 and all the resulting condensate is fed back to the column 2 through an inlet 12 which is located above the top of the liquid-vapour contact means 6. Accordingly, downflow of liquid through the column is provided. The nitrogen gas that enters the column 2 through the inlet 4 ascends the column and comes into contact with the descending liquid and has the heavier impurities (oxygen, argon and carbon monoxide) progressively absorbed into the liquid phase. Thus, the ascending vapour phase becomes progressively leaner and the descending liquid phase becomes progressively richer in the heavy impurities. In addition, the ascending gaseous or vapour from the liquid phase so that the ascending vapour phase becomes progressively richer in light impurities and the descending liquid phase becomes progressively leaner in light impurities.

The condenser 8 has passages (not shown) in which nitrogen vapour from the top of the column is condensed in heat exchange relationship with passages (not shown) through which a refrigerant is passed. The condenser has an inlet 14 and an outlet 16 in communication with the respective ends of the refrigerant passages. A number of different streams are typically available in a conventional air separation plant for providing the necessary refrigeration for the condenser 8 and some examples of such streams are described below with reference to FIGS. 2 to 5. The condenser also has an outlet 18 in communication with the top ends of the condensing passages (not shown) whereby nitrogen relatively rich in light impurities is bled from the condenser so as to prevent an accumulation of such impurities in the condenser 8. Typically, the flow rate of the bleed stream through the outlet 18 is substantially less than 1% of that of the incoming nitrogen stream through the inlet 4 to the column 2. The bleed stream may be mixed with the product nitrogen stream withdrawn from the lower pressure column 46 through the outlet 70.

Liquid collecting at the bottom of the column 2 is typically returned through outlet 20 to the distillation column in which the air is distilled to form the nitrogen stream that is purified in column 2. In the example of distilling air in a double column, the liquid may be continuously returned to the so-called "oxygen-poor" liquid which is used to provide reflux for the lower pressure column. There is also an outlet 22 from the column 2 for the continuous withdrawal of a liquid stream of a second fraction which is relatively lean in heavy impurities in comparison with the nitrogen entering the plant through the inlet 4. The outlet 22 is typically situated at a level a few trays below the top tray in the column 2 so that while it has a substantially reduced volume of heavy impurities, its concentration of light impurities is not the maximum that obtains in the column 2. The column 2 may for example include from 43 to 58 theoretical trays, there being three such trays above the level of the outlet 22 and from 40 to 55 therebelow. The liquid withdrawn from the outlet 22 is then flashed (typically through expansion valve 24) to a lower pressure (typically in the order of 3 atmospheres) and the resulting mixture of residual liquid and flash gas is then separated in phase separator 26. Flash gas is withdrawn from the separator 26 through an outlet 28 at its top and is typically mixed with nitrogen product taken from the column (not shown) in which air is distilled.

Liquid flows continuously from the phase separator 26 through an outlet 30 and is then flashed to a yet lower pressure typically through a valve 32. The resulting mixture of flash gas and residual liquid flows into a second phase separator 34. Phase separator 34 has an outlet 36 through which the flash gas is withdrawn. Flash gas is typically mixed with the nitrogen product of the air distillation. The separator 34 also has an outlet at its bottom 38 through which liquid now substantially free of light impurities and heavy impurities flows to a storage vessel 40 typically at a pressure of about 1.3 atmospheres absolute.

By performing the two flash separations steps it is possible to remove substantially all of the light impurities from the liquid nitrogen stream withdrawn from the column 2 through the outlet 22 without resorting to a further fractionation stage in a second liquid-vapour contact column. Typically, product containing less than 0.05 volumes per million of gaseous impurities can thus be formed by operation of an apparatus of the general kind shown in FIG. 1.

Figure 6:
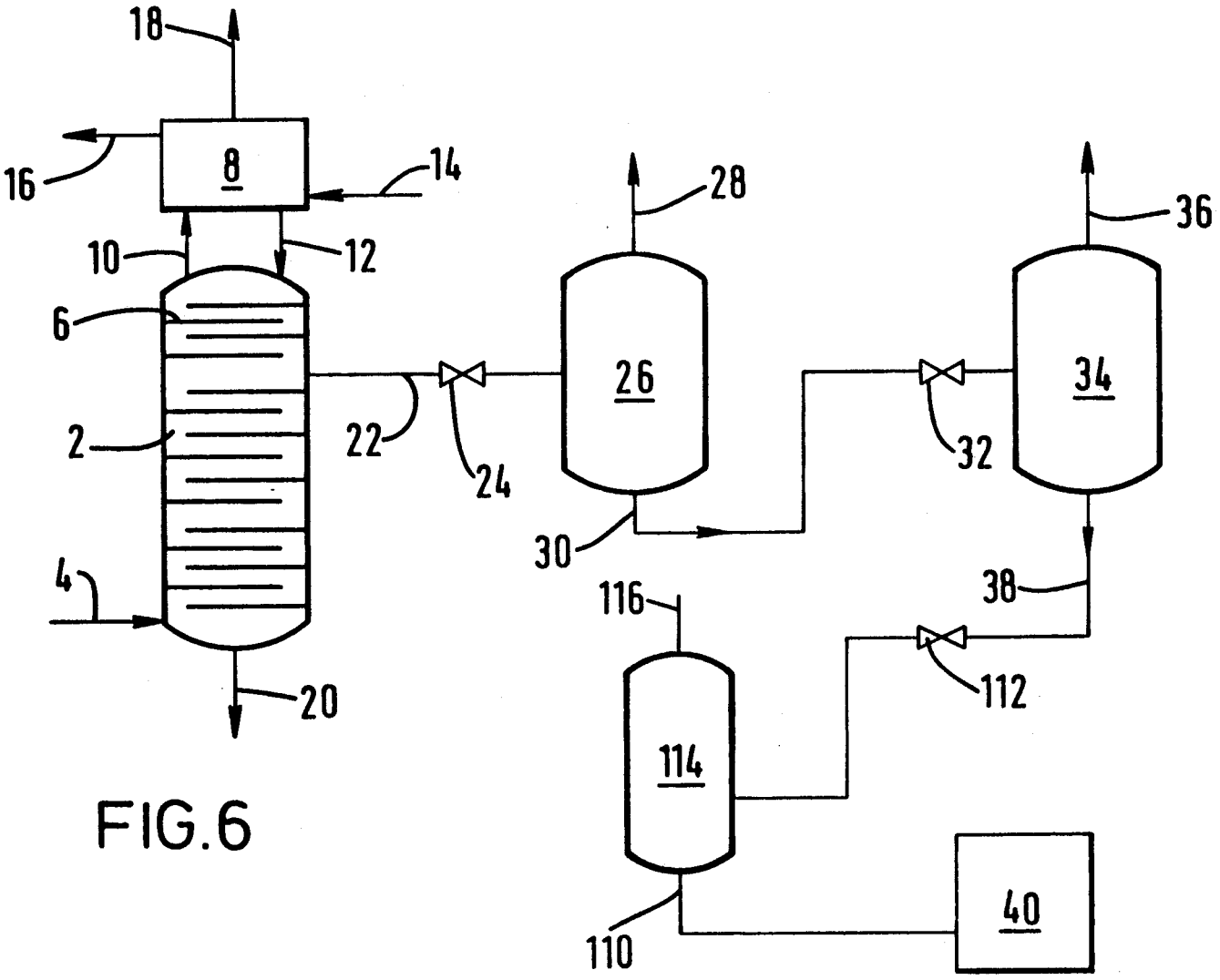
FIG. 6 shows an alternative plant to that shown in FIG. 1.

An enhanced purification can be achieved using three stages of flash separation. A suitable apparatus for this purpose is shown in FIG. 6. The apparatus shown in FIG. 6 is the same as that shown in FIG. 1 save that the liquid from the outlet 38 instead of being passed to the storage vessel 40 is passed through a third (Joule-Thomson) valve 112. The resulting mixture of flash gas and residual liquid flow into a third phase separator 114. The phase separator 114 has an outlet 116 through which the flash gas is withdrawn. The flash gas is typically mixed with the nitrogen product of the air distillation. The separator has an outlet 118 through which the liquid nitrogen now essentially free of light impurities flows to the storage vessel 40. In typical operation of the apparatus shown in FIG. 6, the column 2 is operated at a pressure of about 6 bar absolute, and the phase separators 26, 34 and 114 are maintained at pressures of 3.75, 2.4 and 1.5 bar absolute respectively.

Four different examples of the kind of apparatus illustrated in FIG. 1 are shown in FIGS. 2 to 5 respectively. In FIGS. 2 to 5 all the parts of the apparatus downstream of the outlet 22 are omitted for ease of illustration but it is to be appreciated that these parts are as shown in and described with respect to FIG. 1 of the accompanying drawings.

Figure 2:
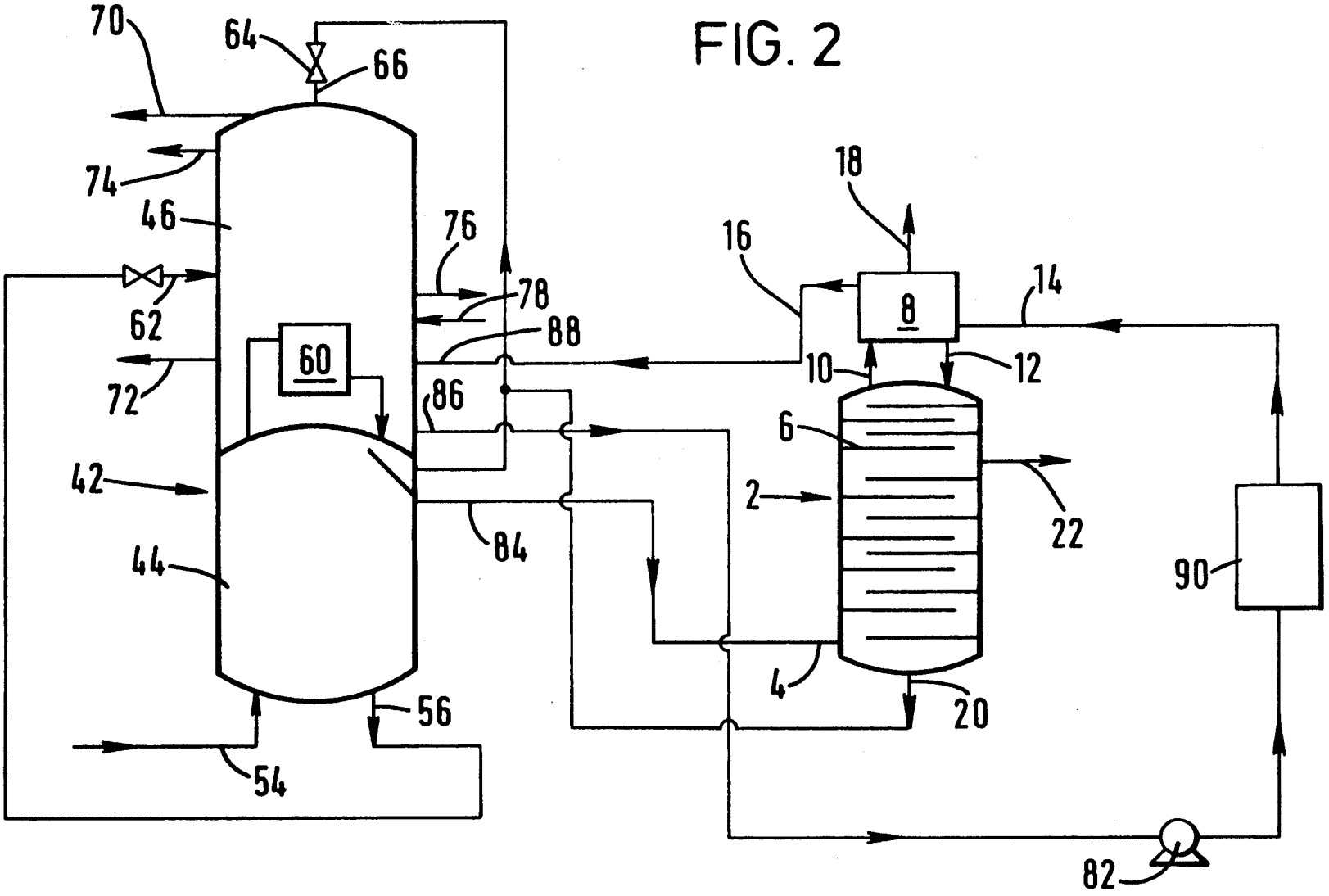
FIGS. 2 to 5 are circuit diagrams of different air separation plants all of the general kind shown in FIG. 1.

Referring to FIG. 2, the nitrogen stream fed to the inlet 4 of the liquid-vapour contact column 2 is taken from the higher pressure column 44 of a double distillation column 42 which in addition to the higher pressure column 44 includes a lower pressure column 46. The column 42 forms part of a conventional air separation plant and the construction and operation of this plant produce oxygen, nitrogen and argon products of ordinary purity will only be described herein in outline. For a fuller description of a conventional double column air separation plant attention is directed to FIG. 1 of European Patent Application No. 296342A and the description thereof.

Air is introduced into the higher pressure column 44 through an inlet 54. It is separated into oxygen-enriched liquid ("RL") and oxygen-poor liquid ("PL"). The column 44 is provided with a condenser 60 at its top which provides liquid nitrogen reflux for it and also provides reboil for the lower pressure column 46. A stream of RL is withdrawn from the bottom of the column 44 through an outlet 56 and after sub-cooling (by means not shown) is introduced into the lower pressure column 46 through an inlet 62. The fluid that is thus introduced into the column 46 is separated into oxygen and nitrogen fractions. To provide liquid nitrogen reflux for the lower pressure column 46, a stream of PL is withdrawn from the higher pressure column 44, is subcooled (by means not shown) and is passed through a Joule-Thomson valve 64 and then through an inlet 66 leading into the top of the lower pressure column 46. Oxygen and nitrogen fractions are produced in the column 46 and are both typically of a purity between 99.0 and 99.9%. A gaseous nitrogen product is withdrawn from the top of the column 46 through an outlet 70, and a gaseous oxygen product from the bottom of the column 46 through an outlet 72. In addition, a waste nitrogen stream is withdrawn from the column 46 through an outlet 74 (and is used for the purposes of regenerating a reversing heat exchanger or other purification unit for removing water vapour and carbon dioxide from the air feed). An argon-enriched oxygen vapour stream is withdrawn from the column 46 through an outlet 76 and is then subjected to further fractionation in a side column (not shown) to produce a crude argon product typically containing in the order of 2% by volume of oxygen. Liquid oxygen is returned from the side column to the column 46 through an inlet 78.

A nitrogen vapour stream is withdrawn through an outlet 84 communicating with a level in the column 44 above that of the liquid-vapour contact means therein and is used to form the nitrogen stream entering the column 2 through the inlet 4. This nitrogen is then separated as described with reference to FIG. 1 of the drawings.

Referring again to FIG. 2, the liquid nitrogen leaving the column 2 through the outlet 20 is combined with the PL upstream of the Joule-Thomson valve 64. Refrigeration for the condenser 8 is provided by withdrawing a stream of liquid oxygen from the bottom of the column 46 through an outlet 86 by means of a pump 82 passing the liquid oxygen through an adsorber 90 for adsorbing hydrocarbon impurities from the liquid oxygen and is then passed through the inlet 14 of the condenser 8. Liquid oxygen vaporizes during its passage through the condenser 8 thereby providing condensation for the nitrogen. The resulting vaporized oxygen leaves the condenser through the outlet 16 and returns to the lower pressure column below the level of the liquid-vapour contact means therein through an inlet 88 or may be mixed with the gaseous oxygen product withdrawn from the lower pressure column 72 through the outlet 72. A nitrogen stream having a reduced concentration of heavy impurities is withdrawn through the outlet 22 and is further purified as described above with reference to FIG. 1.

Figure 3:
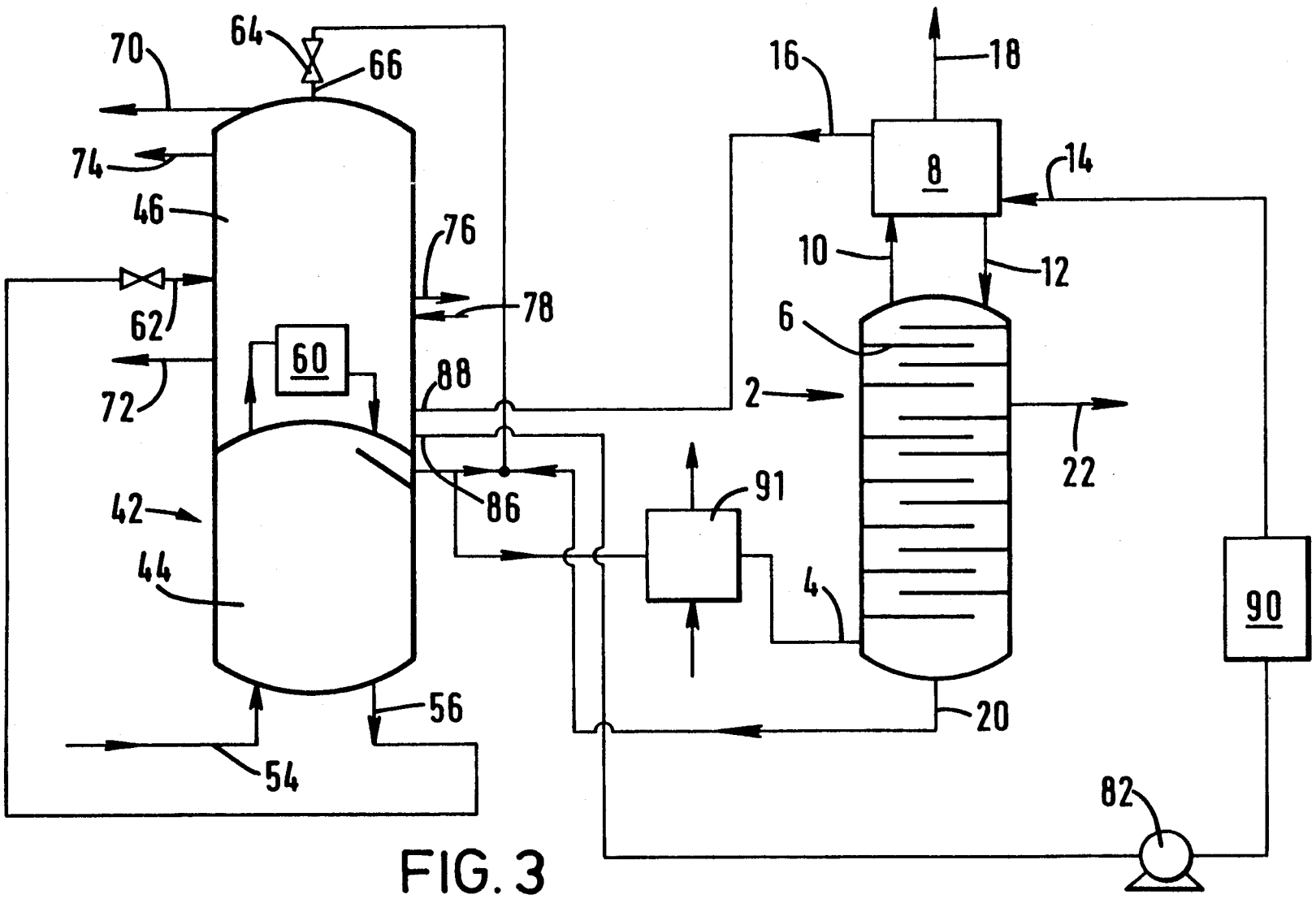

Referring now to FIG. 3, the apparatus illustrated therein and its operation is the same as that shown in FIG. 2 save that there is no outlet 84 for nitrogen vapour at the top of the column 44: instead the part of the PL is taken as the feed for the column 2 is vaporized in a reboiler 91 by heat exchange with a countercurrent air stream and then fed to the column 2 through the inlet 4. The air for the reboiler 91 is taken from the air stream fed to the inlet 54 of the higher pressure column 44 of the double column 42 and the resulting liquid air is also returned to the column 44 through a raised air feed (not shown).

Figure 4:
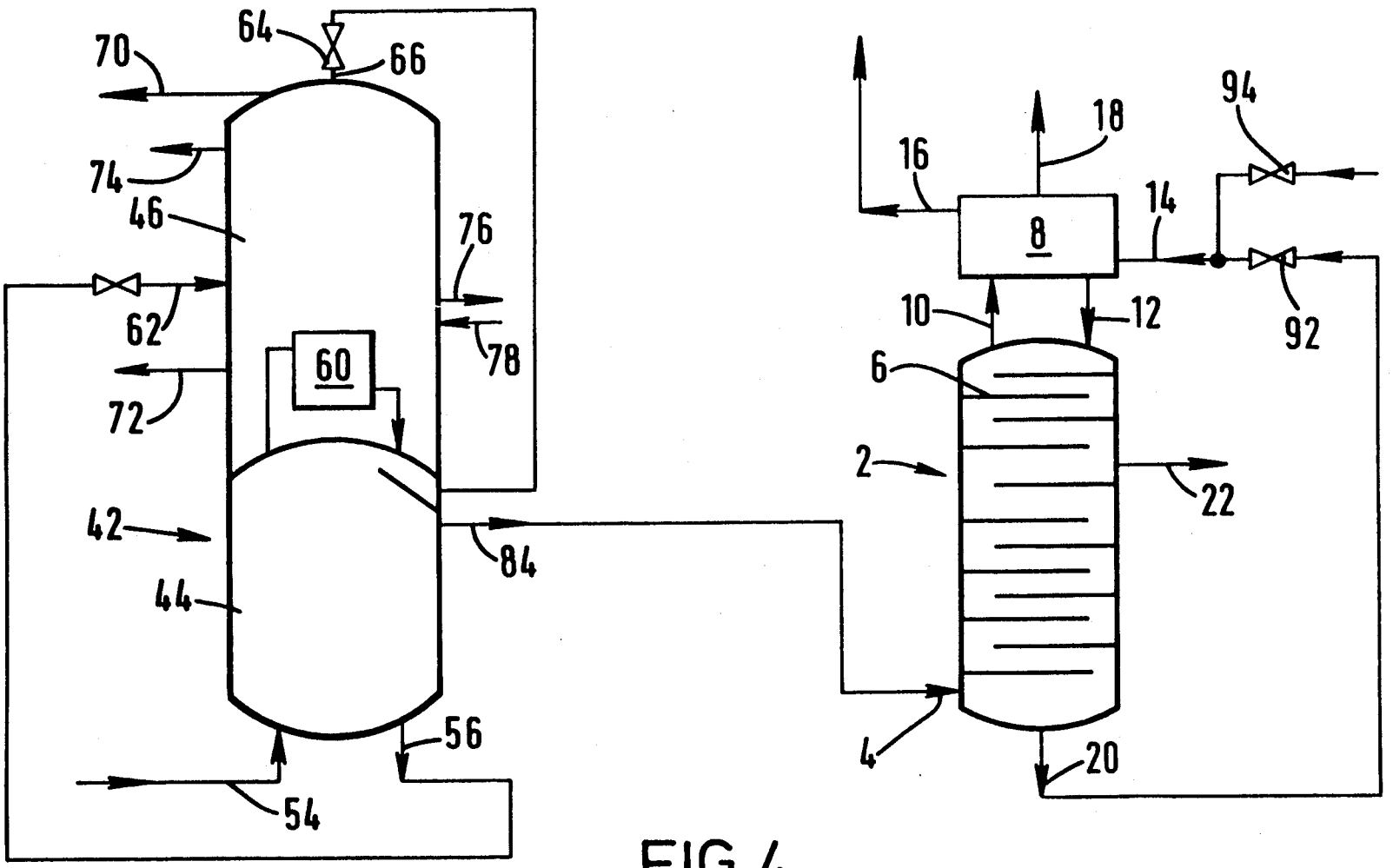

Referring now to FIG. 4 of the accompanying drawings, as in the apparatus shown in FIG. 2, the source of nitrogen feed for the column 2 is an outlet 84 from the top of the higher pressure column 44. However, instead of using liquid oxygen from the column 40 to provide the source of the refrigerant for the condenser 8, liquid nitrogen withdrawn from the column 2 through the outlet 20 is used for this purpose. There is thus no return of any liquid nitrogen from the outlet 20 to the double column 42. Since generally the nitrogen 20 from the bottom of the column 2 will not meet all the refrigeration requirements of the condenser 8 an additional source of liquid nitrogen is supplied for this purpose. Typically the additional nitrogen may come from the poor liquid (PL) of the double column 40. The nitrogen that is withdrawn from the bottom of the column 2 through the outlet 20 is passed through a pressure reducing valve 92 upstream of the inlet 14 to the condenser 10, its pressure being reduced to the order of 5 atmospheres. The additional liquid nitrogen is if necessary similarly passed through a valve 94 to reduce its pressure upstream of being mixed with the nitrogen downstream of the valve 92. The liquid nitrogen refrigerant stream passing through the condenser 8 is vaporized and the resultant nitrogen vapour leaves the condenser 8 through the outlet 16. This nitrogen can be taken as an intermediate pressure product or reduced in pressure and mixed with the main gaseous product of the double column 40.

If the double column is used to provide an argon-enriched stream for further separation to produce an argon product, the apparatus as shown in FIG. 4 will tend to suffer from the drawback that since liquid nitrogen from the column 2 is not returned to the PL stream, the amount of reflux for the lower pressure column 46 is reduced and therefore the rate at which argon can be produced in significantly reduced.

Figure 5:
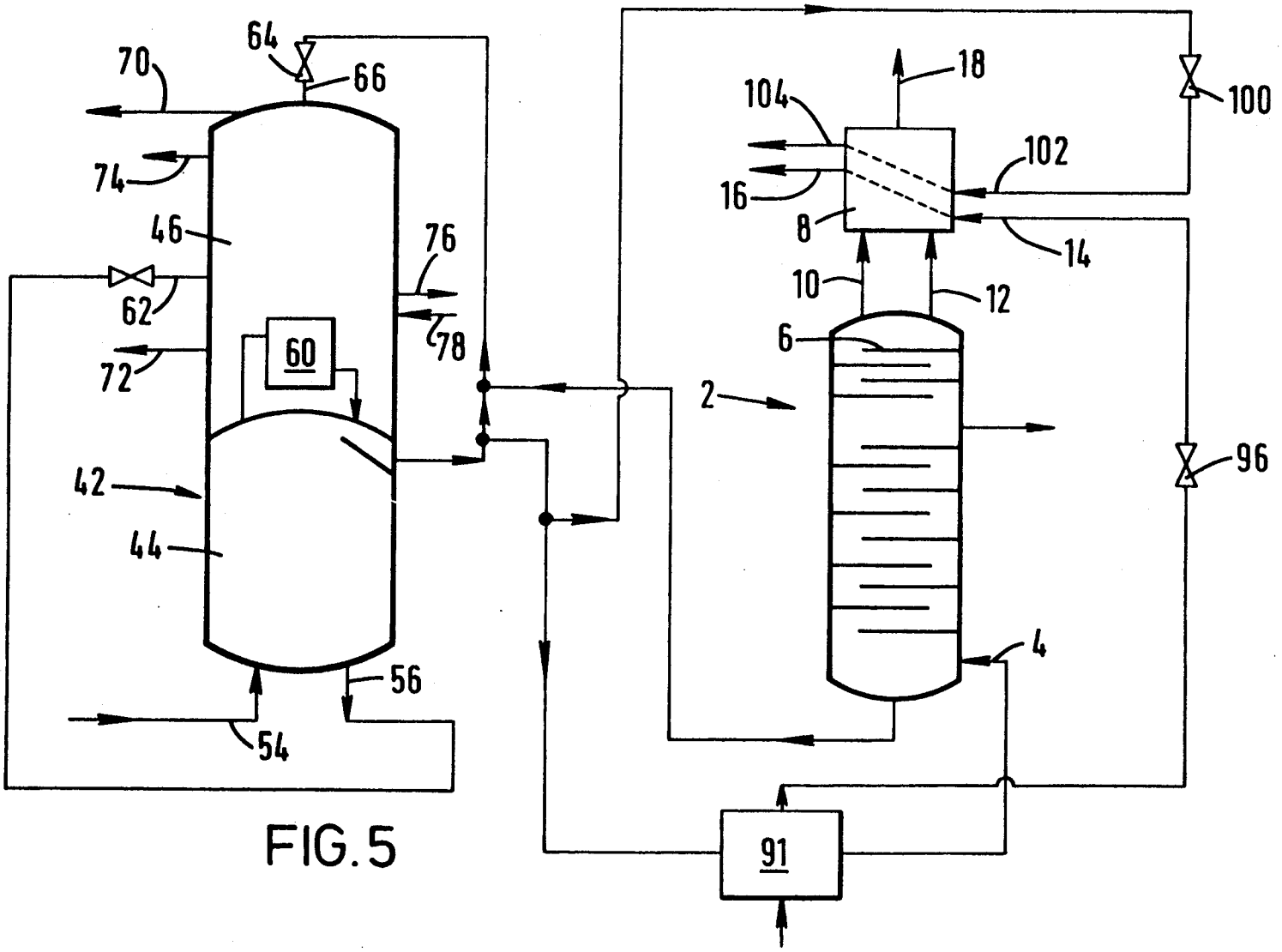

Referring now to FIG. 5 of the drawings, the poor liquid from the double column is, as in FIG. 3, used as the source of the nitrogen stream that is fed to the column 2 through the inlet 4. However, instead of using liquid oxygen to provide refrigeration for the condenser 8, two separate streams one of liquid air and the other of liquid nitrogen are used for this purpose and the condenser is thus provided with three sets of heat exchange passages (not shown), one set being for condensing the nitrogen vapour from the top of the column, a second set being for the liquid nitrogen refrigerant, and a third set being for the liquid air refrigerant. Accordingly, instead of returning the air leaving the reboiler 90 directly to the high pressure column 44 as in the apparatus shown in FIG. 3, this liquid air is passed through a pressure reduction valve 96 to reduce its pressure to about 1.5 atmospheres absolute and the resulting liquid is then supplied to the inlet 14 of the condenser 8. The air is vaporized passing through the condenser 8 and the resulting vaporized air leaves the condenser 8 through the outlet 16 and may be introduced into the lower pressure column 46 through an inlet (not shown) as Lachmann air. Additional refrigeration for the condenser 8 is provided by taking a further portion of the PL, passing it through an expansion valve 100 to reduce its pressure to about 1.5 atmospheres absolute and then introducing it into the condenser through an additional inlet 102. The liquid nitrogen refrigerant is vaporized as it flows through the condenser 8 and the resulting vapour leaves the condenser 8 through an additional outlet 104 and may then be combined with the main product nitrogen stream of the double column 40.

In comparison with the apparatus shown in FIG. 3, there will be a reduced rate of production of argon in the event that the double column 40 is used to provide an argon-enriched stream for further separation to form an argon product.

A computer simulated example of the operation of the apparatus shown in FIG. 3 is set out in Table 1 below:

TABLE 1

| | Nitrogen Stream in | | | | | |
|---|---|---|---|---|---|---|
| | Inlet 2 | Outlet 20 | Outlet 18 | Outlet 22 | Outlet 28 | Outlet 30 |
| Flow rate: as % of air flow rate entering the inlet 2 | 100 | 85.7 | 0.04 | 13.9 | 0.15 | 12.4 |
| Temperature: (K) | 97 | 97 | 96.3 | 96.6 | 88.1 | 88.1 |
| Pressure Atma | 6.2 | 6.2 | 6.0 | 6.0 | 3.0 | 3.0 |
| State: (L = liquid; V = vapour) | V | L | V | L | V | L |
| Impurities: | | | | | | |
| $O_2$ | 1 vpm | 1 vpm | — | — | — | — |
| Ar | 150 vpm | 175 vpm | <1 ppb | <1 ppb | <1 ppb | <1 ppb |
| CO | 1.5 vpm | 1.75 vpm | 10 ppb | 10 ppb | 7 ppb | 10 ppb |
| Ne | 40 vpm | 1 vpm | 1% | 1 vpm | 8 vpm | 8 ppb |
| He | 6 vpm | 0.1 vpm | 0.15% | 0.1 vpm | 1 vpm | 1 ppb |
| $H_2$ | 1 vpm | 30 ppb | 250 vpm | 30 ppb | 0.3 vpm | 1 ppb |

| | Nitrogen Stream in | | Air Stream in | | Oxygen Stream in | |
|---|---|---|---|---|---|---|
| | Outlet 34 | Product | Inlet to Reboiler 90 | Outlet from Reboiler 90 | Inlet 14 | Outlet 16 |
| Flow rate: as % of air flow rate entering the inlet 2 | 0.11 | 11.3 | 93.2 | 93.2 | 70.4 | 70.4 |
| Temperature: (K) | 79.6 | 79.6 | 102 | 99.8 | 94.8 | 94.8 |
| Pressure Atma | 1.3 | 1.3 | 6.5 | 6.5 | 1.6 | 1.6 |
| State: (L = liquid; V = vapour) | V | L | V | L | L | V |
| Impurities: | | | | | | |
| $O_2$ | — | — | | | | |
| Ar | <1 ppb | <1 ppb | | | | |
| CO | 6 ppb | 10 ppb | | | | |
| Ne | 1.3 vpm | 8 ppb | | | | |
| He | 36 ppb | 1 ppb | | | | |
| $H_2$ | 28 ppb | 1 ppb | | | | |

Key:
1 vpm = 1 volume per million
1 ppb = 1 volume per billion (ie thousand million)

We claim:

1. A method of purifying nitrogen containing light impurities and heavy impurities comprising: introducing under pressure a stream of the nitrogen into a liquid-vapor contact column so that an ascending flow of nitrogen gas is produced within the liquid-vapor contact column; extracting the nitrogen gas from the top of the liquid-vapor contact column and condensing it to form a condensate; introducing the condensate into the top of the liquid-vapor contact column to produce a descending flow of liquid nitrogen; absorbing the heavy impurities into the descending flow of liquid nitrogen and stripping the light impurities therefrom into the ascending flow of nitrogen gas so that the descending flow of liquid nitrogen becomes progressively richer in the heavy impurities and leaner in the light impurities as it descends in the liquid-vapor contact column and the ascending flow of nitrogen gas becomes progressively richer in the light impurities and leaner in heavy impurities as it ascends in the liquid-vapor contact column; withdrawing from the liquid-vapor contact column a liquid nitrogen stream having a reduced concentration of heavy impurities and subjecting the liquid nitrogen stream to at least one stage of flash separation to produce a liquid nitrogen product having a heavy impurity concentration less than that of the nitrogen to be purified and a reduced concentration of the light impurities.

2. The method as claimed in claim 1, in which the liquid nitrogen stream is subjected to two of the at least one stage of flash separation.

3. The method as claimed in claim 1, in which the second nitrogen stream is subjected to three of the at least one stages of flash separation.

4. The method as claimed in claim 1, in which refrigeration for the condensation is provided by liquid oxygen.

5. The method as claimed in claim 1, in which the feed nitrogen stream is taken from the higher pressure column of a double column for separating air into oxygen and nitrogen.

6. The method as claimed in claim 5, in which the feed nitrogen stream is taken into the vapour state.

7. The method as claimed in claim 5, in which the feed nitrogen stream is taken in the liquid state and is reboiled upstream of where it is introduced into the liquid-vapor contact column.

8. The method as claimed in claim 1, in which a purified nitrogen product containing less than 0.1 volumes per million of impurities is produced.

9. An apparatus for purifying nitrogen containing light and heavy impurities and obtained from a feed nitrogen stream under pressure, said apparatus comprising: a liquid-vapor contact column having a bottom inlet for the feed nitrogen stream under pressure to produce an ascending flow of nitrogen gas within the liquid-vapor contact column; means for condensing the ascending flow of the nitrogen gas and for creating in the column a descending flow of liquid nitrogen, whereby the column is operable to absorb the heavy impurities into the descending flow of liquid nitrogen and to strip the light impurities therefrom into the ascending flow of nitrogen gas so that the descending flow of liquid nitrogen becomes progressively richer in the heavy impurities and leaner in the light impurities as it descends in the liquid-vapor contact column and the ascending flow of nitrogen gas becomes progressively richer in the light impurities and leaner in heavy impurities as it ascends in the liquid-vapor contact column; the liquid-vapor contact column also having an outlet for extracting a liquid nitrogen stream, the outlet located at a level of the column at which the liquid nitrogen has a reduced concentration of the heavy impurities; and means including at least one stage of flash separation for separating the light impurities from the liquid nitrogen stream and thereby producing a product stream having a heavy impurity concentration less than the nitrogen to be purified and a reduced concentration of the light impurities.

10. The apparatus as claimed in claim 9, in which there are two of the at least one stage of flash separation.

11. The apparatus as claimed in claim 9, in which there are three of the at least one stage of flash separation.

12. The apparatus as claimed in claim 9, in which the means for condensing the ascending flow of nitrogen gas and for providing the descending flow of liquid nitrogen is a condenser having as inlet for vapour in communication with the top of the column and an outlet for condensate in communication with the top of the column.

13. The apparatus as claimed in claim 12, in which the passages in the condenser in which in operation the nitrogen vapour is condensed communicate with an outlet for uncondensed vapour, whereby a bleed of uncondensed vapour is able to be discharged from the condenser.

14. The apparatus as claimed in claim 9, wherein the source of nitrogen is the higher pressure column of a double distillation column for separating air into oxygen and nitrogen.

15. The apparatus as claimed in claim 14, additionally including a reboiler for reboiling liquid nitrogen feed upstream of the said liquid-vapor contact column.

* * * * *